US010886666B2

(12) United States Patent
Peng et al.

(10) Patent No.: US 10,886,666 B2
(45) Date of Patent: Jan. 5, 2021

(54) LOW RESONANCE ELECTRICAL CONNECTOR

(71) Applicant: Tyco Electronics (Shanghai) Co. Ltd., Shanghai (CN)

(72) Inventors: Wei Peng, Shanghai (CN); Fengping Xu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/292,848

(22) Filed: Mar. 5, 2019

(65) Prior Publication Data

US 2019/0280434 A1 Sep. 12, 2019

(30) Foreign Application Priority Data

Mar. 9, 2018 (CN) ..... 2018 1 0195503

(51) Int. Cl.

| | |
|---|---|
| ***H01R 13/6471*** | (2011.01) |
| ***H01R 13/6585*** | (2011.01) |
| ***H01R 13/6583*** | (2011.01) |
| ***H01R 13/66*** | (2006.01) |
| ***H01R 12/72*** | (2011.01) |

(52) U.S. Cl.

CPC ..... *H01R 13/6471* (2013.01); *H01R 12/724* (2013.01); *H01R 13/6583* (2013.01); *H01R 13/6585* (2013.01); *H01R 13/66* (2013.01)

(58) Field of Classification Search

CPC ..... H01R 13/6471; H01R 13/6583; H01R 13/6585; H01R 13/66; H01R 12/724

See application file for complete search history.

(56) References Cited

U.S. PATENT DOCUMENTS

| | | | | |
|---|---|---|---|---|
| 6,276,945 | B1 * | 8/2001 | Hayward | H01R 13/6588 439/82 |
| 6,994,569 | B2 * | 2/2006 | Minich | H01R 29/00 439/79 |
| 8,267,721 | B2 * | 9/2012 | Minich | H01R 12/724 439/607.05 |
| 8,616,919 | B2 * | 12/2013 | Stoner | H01R 13/6587 439/607.07 |
| 9,048,583 | B2 * | 6/2015 | Johnescu | H01R 13/514 |
| 2011/0097934 | A1 * | 4/2011 | Minich | H01R 12/724 439/607.53 |
| 2011/0117781 | A1 * | 5/2011 | Stoner | H01R 13/6587 439/607.01 |
| 2012/0214343 | A1 * | 8/2012 | Buck | H01R 13/6586 439/607.05 |
| 2016/0141807 | A1 * | 5/2016 | Gailus | H01R 12/7076 439/607.05 |
| 2018/0109043 | A1 * | 4/2018 | Provencher | H01R 13/6598 |
| 2019/0013625 | A1 * | 1/2019 | Gailus | H01R 13/6585 |
| 2019/0280434 | A1 * | 9/2019 | Peng | H01R 13/6585 |

* cited by examiner

*Primary Examiner* — Abdullah A Riyami
*Assistant Examiner* — Nader J Alhawamdeh
(74) *Attorney, Agent, or Firm* — Barley Snyder

(57) ABSTRACT

A connector includes at least one ground contact, at least one signal contact, and a member disposed near the at least one ground contact. The member is made of a magnetic conductivity material or a low electrical conductivity metal. An insulation body is provided for housing the at least one ground contact and the at least one signal contact. The member may be arranged at least one of on or within the insulation body for reducing resonance energy generated by the at least one signal contact.

41 Claims, 8 Drawing Sheets

LOW RESONANCE ELECTRICAL CONNECTOR

CROSS-REFERENCE TO RELATED APPLICATION

This application claims the benefit of the filing date under 35 U.S.C. § 119(a)-(d) of Chinese Patent Application No. 201810195503.7, filed on Mar. 9, 2018.

FIELD OF THE INVENTION

The present invention relates to a connector and, more particularly, to a connector having a contact.

BACKGROUND

A connector generally comprises a plurality of ground contacts and a plurality of signal contacts. In order to reduce signal crosstalk between signal contacts, it is necessary to eliminate or suppress resonance between signal contacts.

There are two main solutions to eliminate the resonance. The first solution is to use conductive plastic to wrap the ground contact, however, the conductive plastic is very expensive. The second solution is to use a single ground bar to connect the plurality of ground contacts together, however, this solution can only increase the resonant frequency of the resonance and cannot eliminate the resonance. The ground bar is also difficult to install.

SUMMARY

A connector includes at least one contact and a member disposed near at least one of the at least one contact. The member is made of a magnetic conductivity material or a low electrical conductivity metal.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
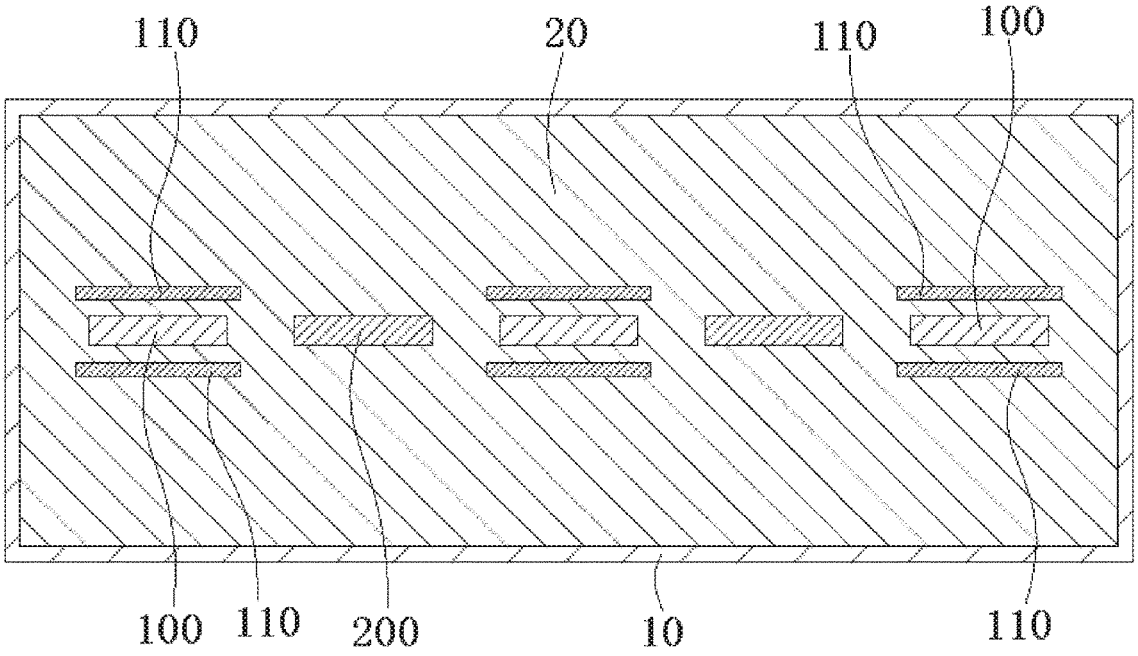
FIG. 1 is a sectional side view of a connector according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the disclosure to those skilled in the art. In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A connector according to an embodiment, as shown in FIG. 1, comprises at least one contact 100, 200 and a member 110 provided near at least one of the at least one contact 100, 200.

The member 110 is made of a magnetically conductive material or a low electrically conductive metal. In an embodiment, the member 110 may be made of a high magnetically conductive material; the member 110 may be made of a high magnetic conductivity material with a relative magnetic conductivity larger than 10. A magnetic conductivity material will significantly increase the skin effect of the material due to existence of magnetic permeability, which will greatly increase surface current density and greatly increase the resistance. The high resistance may be used to absorb resonance energy, and a magnetic loss angle may also absorb resonant energy of some alternating magnetic fields. In another embodiment, the member 110 may be made of a low electrically conductive metal; the member 110 may be made of a low electrical conductivity metal with an electric conductivity less than 1.16e6 siemens/meter. A low electrical conductivity metal may bring high resistance due to its low electrical conductivity property, and the high resistance may be used to absorb the resonance energy. In an embodiment, the magnetic conductivity material contains but is not limited to pure iron, silicon steel, alloy steel, stainless steel (for example, SUS430), or the like. The low electrical conductivity metal includes but is not limited to stainless steel, Ni—Fe—Cr alloy, or the like.

As shown in FIG. 1, in an embodiment, the at least one contact 100, 200 includes a ground contact 100 and a signal contact 200. The member 110 is disposed at a position near each ground contact 100. In an embodiment, the ground contact 100 may be configured to be a ground terminal or a ground shield. In an embodiment, the member 110 may be in direct contact with the ground contact 100 or not in contact with the ground contact 100.

In another embodiment, in which the member 110 is omitted, the ground contact 100 is partly or entirely made of a magnetic conductivity material or a low electrical conductivity metal. The magnetic conductivity material or the low electrical conductivity metal may be formed as a coating layer on the ground contact 100 by electroplating.

In the embodiment shown in FIG. 1, the member 110 is not in contact with the ground contact 100, and a distance between the member 110 and the ground contact 100 is in a range of 0-1 millimeter (mm). In another embodiment, the distance between the member 110 and the ground contact 100 may be in a range of 0-0.1 mm. In yet another embodiment, the distance between the member 110 and the ground contact 100 may be in a range of 0-0.01 mm.

Figure 2:
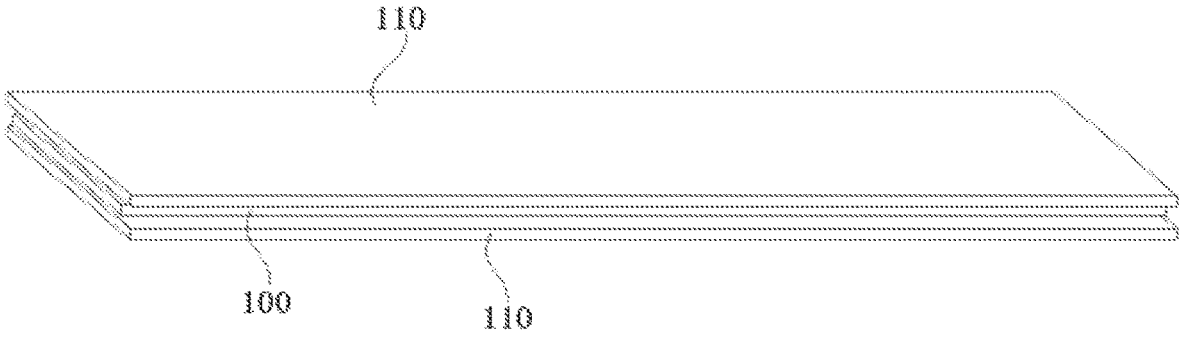
FIG. 2 is a perspective view of a ground contact and a member of the connector of FIG. 1.

FIG. 2 shows a ground contact 100 and a member 110 provided near the ground contact 100 of the connector shown in FIG. 1. As shown in the embodiment of FIGS. 1 and 2, the members 110 are disposed both at a top side and a bottom side of the ground contact 100. In other embodiments, the member 110 may be disposed only at the top side of the ground contact 100, the member 110 may be disposed only at the bottom side of the ground contact 100, the member 110 may be disposed only at a left side of the ground contact 100, or the member 110 may be disposed only at a right side of the ground contact 100.

In the embodiment shown in FIGS. 1 and 2, the member 110 is a strip-shaped sheet member. The member 110 is positioned above or below the ground contact 100, so that the ground contact 100 is at least partially overlapped with the member 110 in a width direction of the ground contact 100. In other embodiments, the member 110 may be a case member with a predetermined length. In such an embodiment, the ground contact 100 is received in the member 110, so that the ground contact 100 is at least partially enclosed by the member 110 or is at least partially overlapped with the member 110.

In the embodiment shown in FIGS. 1 and 2, the member 110 has a width larger than or equal to that of the ground contact 100, and is located above or below the ground contact 100, so that the ground contact 100 is completely covered by the member 110 in a width direction of the ground contact 100. The member 110 has a length larger than or equal to that of the ground contact 100, and extends over the whole length of the ground contact 100, so that the ground contact 100 is completely overlapped with the member 110 in a length direction of the ground contact 100. In other embodiments, the member 110 may have a length less than that of the ground contact 100, and the member 110 partially overlaps the ground contact 100 in the length direction of the ground contact 100, as shown in FIG. 4B.

In an embodiment, the at least one contact 100, 200 includes a plurality of ground contacts 100 and a plurality of signal contacts 200. The plurality of ground contacts 100 and the plurality of signal contacts 200 are arranged in at least one row. As shown in FIGS. 1 and 2, in an embodiment, the connector comprises three ground contacts 100 and two signal contacts 200.

At least one signal contact 200 or a pair of signal contacts 200 are disposed between two adjacent ground contacts 100.

Figure 3A:
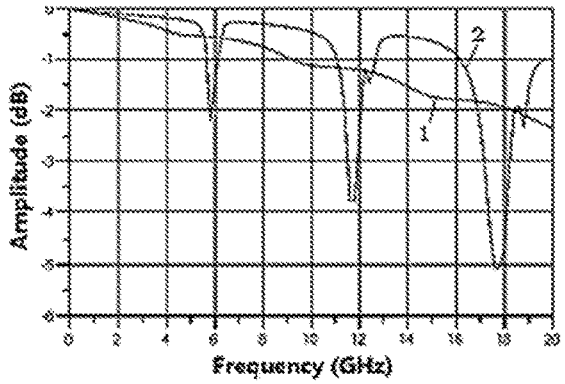
FIG. 3A is a graph of a signal crosstalk between a first pair of ends of two signal contacts of the connector of FIG. 1.
Figure 3B:
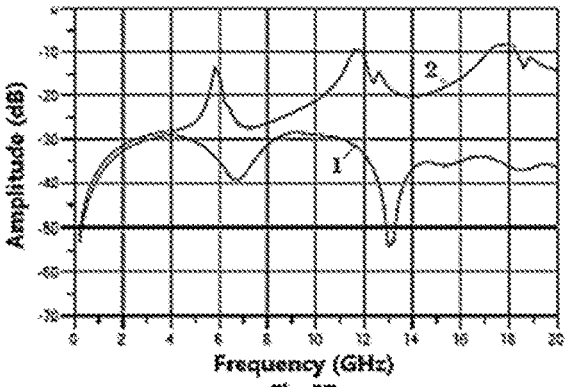
FIG. 3B is a graph of a signal crosstalk between a second pair of ends of two signal contacts of the connector shown in FIG. 1.
Figure 3D:
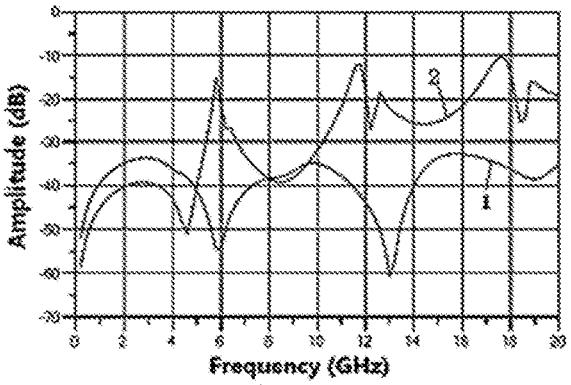
FIG. 3D is a graph of a signal crosstalk between a fourth pair of ends of two signal contacts of the connector shown in FIG. 1.
Figure 3C:
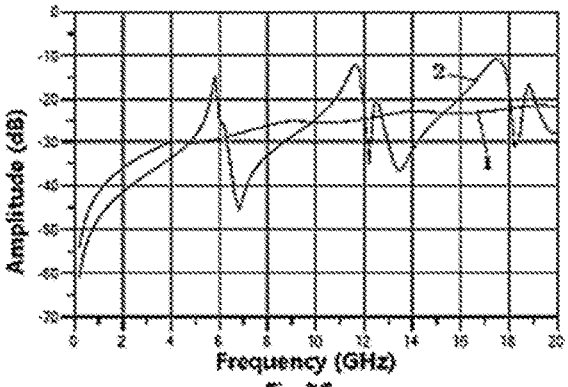
FIG. 3C is a graph of a signal crosstalk between a third pair of ends of two signal contacts of the connector shown in FIG. 1.

FIG. 3A is a graph of a signal crosstalk between a first pair of ends, also referred to as ports, of four pairs of ends of two signal contacts 200; a signal crosstalk between one end of one signal contact 200 and one end of another signal contact 200 of the connector shown in FIG. 1. FIG. 3B is a graph of a signal crosstalk between a second pair of ends of the four pairs of ends of two signal contacts 200 of the connector shown in FIG. 1. FIG. 3C is a graph of a signal crosstalk between a third pair of ends of the four pairs of ends of two signal contacts 200 of the connector shown in FIG. 1. FIG. 3D is a graph of a signal crosstalk between a fourth pair of ends of the four pairs of ends of two signal contacts 200 of the connector shown in FIG. 1. As shown in FIGS. 3A-3D, a first curve 1 represents the member 110 disposed near the ground contact 100, and a second curve 2 represents no member 110 near the ground contact 100. As shown in FIGS. 3A-3D, an amplitude of the curve 1 is much less than that of the curve 2, indicating that the member 110 provided near the ground contact 100 may eliminate the resonance and reduce the crosstalk between the signal contacts 200, effectively reducing insertion loss and echo loss of the signal contacts 200.

Figure 4A:
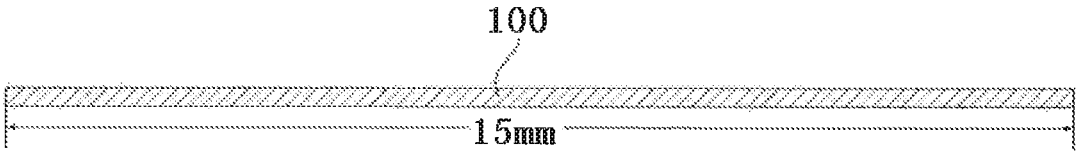
FIG. 4A is a sectional side view of an embodiment in which no member is disposed near the ground contact.
Figure 4B:
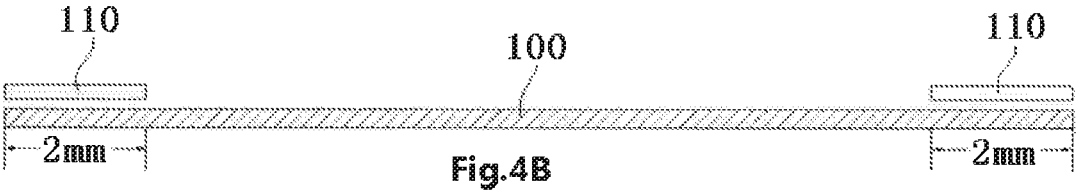
FIG. 4B is a sectional side view of the member with a first length disposed at each end of the ground contact.
Figure 4C:
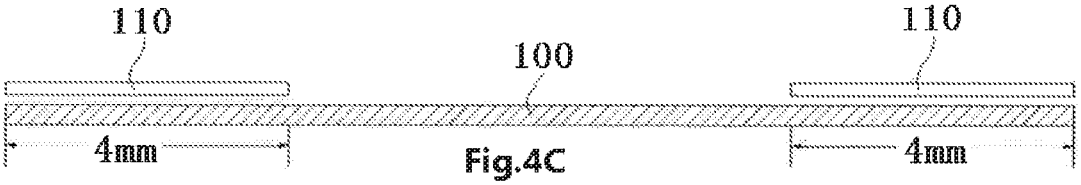
FIG. 4C is a sectional side view of the member with a second length disposed at each end of the ground contact.
Figure 4D:
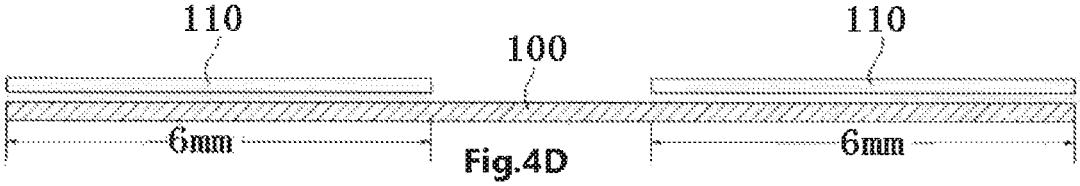
FIG. 4D is a sectional side view of the member with a third length disposed at each end of the ground contact.
Figure 4E:
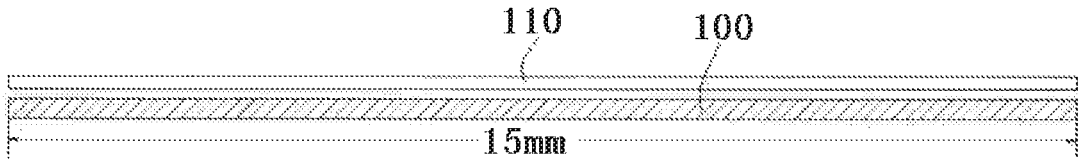
FIG. 4E is a sectional side view of the member extending over a whole length of the ground contact.

FIGS. 4A-4E show various embodiments of the ground contact 100 and the member 110. FIG. 4A shows an embodiment in which there is no member 110 near the ground contact 100. FIG. 4B shows an embodiment in which the member 110 with a length of 2 mm is disposed at each end of the ground contact 100. FIG. 4C shows an embodiment in which the member 110 with a length of 4 mm is disposed at each end of the ground contact 100. FIG. 4D shows an embodiment in which the member 110 with a length of 6 mm is disposed at each end of the ground contact 100. FIG. 4E shows an embodiment in which the member 110 extends over the whole length of the ground contact 100.

Figure 5:
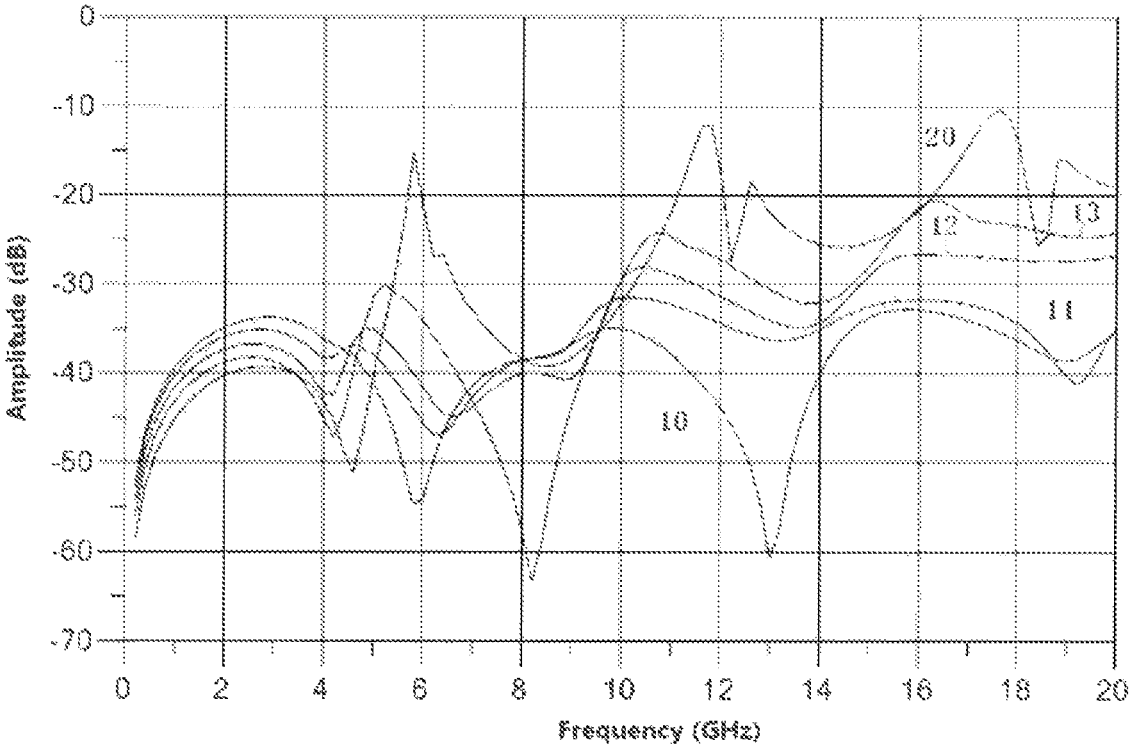
FIG. 5 is a graph of a signal crosstalk between the third pair of ends of the two signal contacts in the embodiments shown in FIGS. 4A-4E.

FIG. 5 is a graph of a signal crosstalk between the third pair of ends of two signal contacts 200 in the various embodiments shown in FIGS. 4A-4E. In FIG. 5, the first curve 10 corresponds to the embodiment of FIG. 4E, the second curve 11 corresponds to the embodiment of FIG. 4D, the third curve 12 corresponds to the embodiment of FIG. 4C, the fourth curve 13 corresponds to the embodiment of FIG. 4B, and the fifth curve 20 corresponds to the embodiment of FIG. 4A. As shown in FIG. 5, the signal crosstalk between signal contacts 200 is minimal in the embodiment in which the member 110 extends over the whole length of the ground contact 100.

Figure 6:
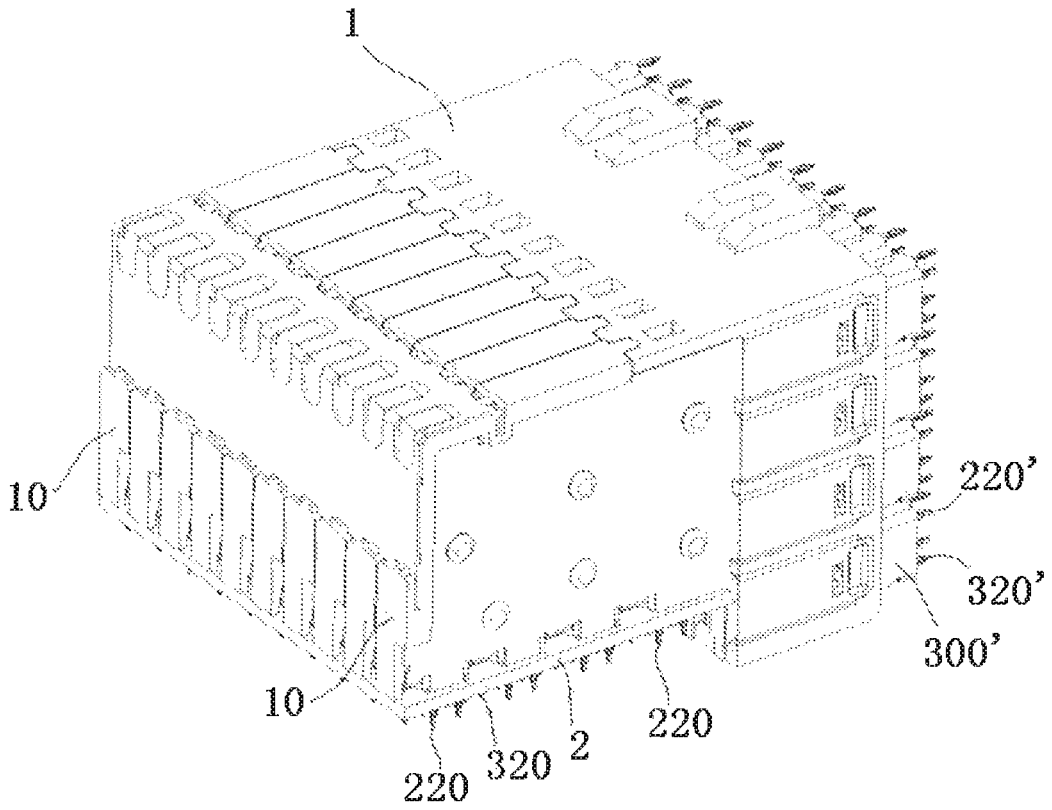
FIG. 6 is a perspective view of a connector according to another embodiment with a mating connector.
Figure 7:
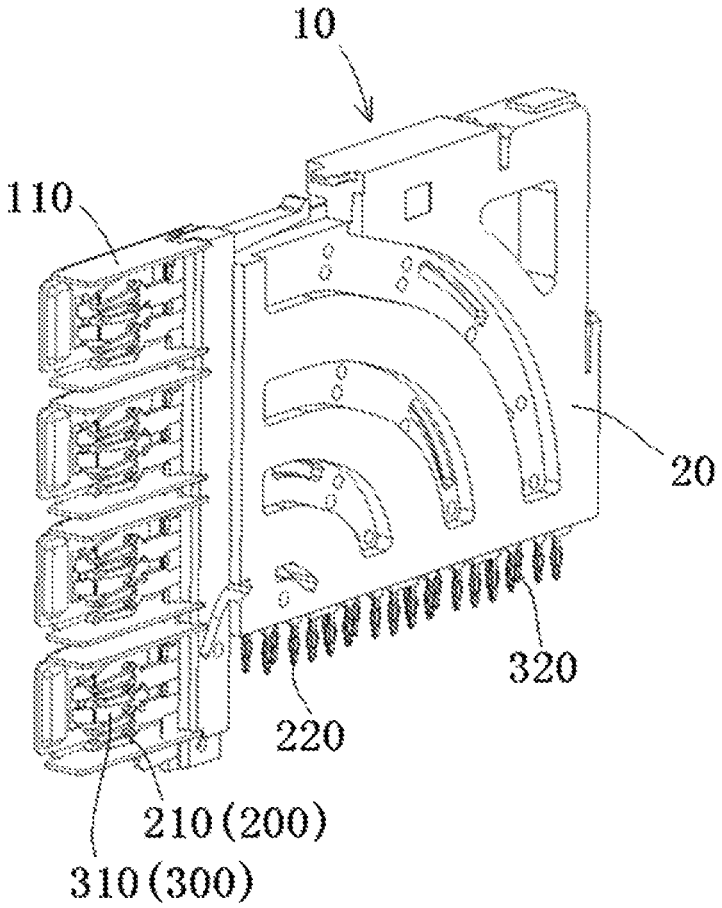
FIG. 7 is a perspective view of a contact module of the connector of FIG. 6.

A connector according to another embodiment, as shown in FIGS. 6 and 7, comprises a case 1, a ground contact 300, and a plurality of contact modules 10 assembled in the case 1 side by side. A mating connector having a mating ground shield 300' and a mating signal contact 200' is adapted to be mated with the connector.

Figure 8:
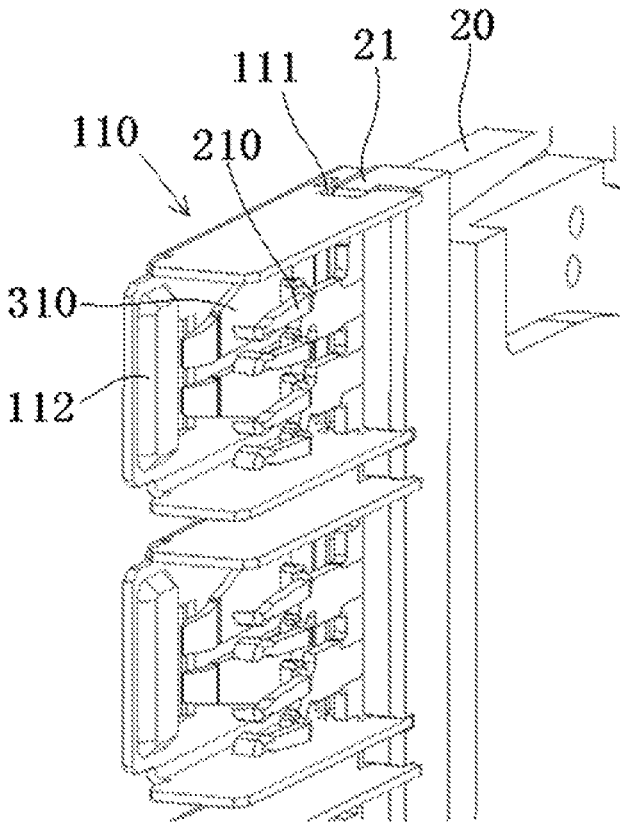
FIG. 8 is an enlarged perspective view of a portion of the contact module of FIG. 7.

As shown in FIGS. 6-8, in an embodiment, each contact module 10 includes an insulation body 20 and the signal contact 200 provided in the insulation body 20. The ground contact 300 is provided on the insulation body 20, and in an embodiment, is disposed on one side of the insulation body 20. The member 110 is disposed near the ground contact 300. In an embodiment, the ground contact 300 is a ground shield. In other embodiments, the ground contact 300 may be a ground terminal.

The signal contact 200, as shown in FIGS. 7 and 8, has a signal contact portion 210 disposed at an end thereof and exposed outside of the insulation body 20. The member 110 is disposed near the signal contact portion 210 of the signal contact 200.

The ground shield 300, as shown in FIGS. 7 and 8, has a ground contact portion 310 disposed at an end thereof and exposed outside of the insulation body 20. The ground contact portion 310 of the ground shield 300 is disposed near the signal contact portion 210 of the signal contact 200. The member 110 is disposed near the ground contact portion 310 of the ground shield 300. In an embodiment, the ground shield 300 comprises a plurality of ground contact portions 310 disposed near the signal contact portion 210 of the signal contact 200; the member 110 is disposed near the ground contact portions 310.

Figure 9:
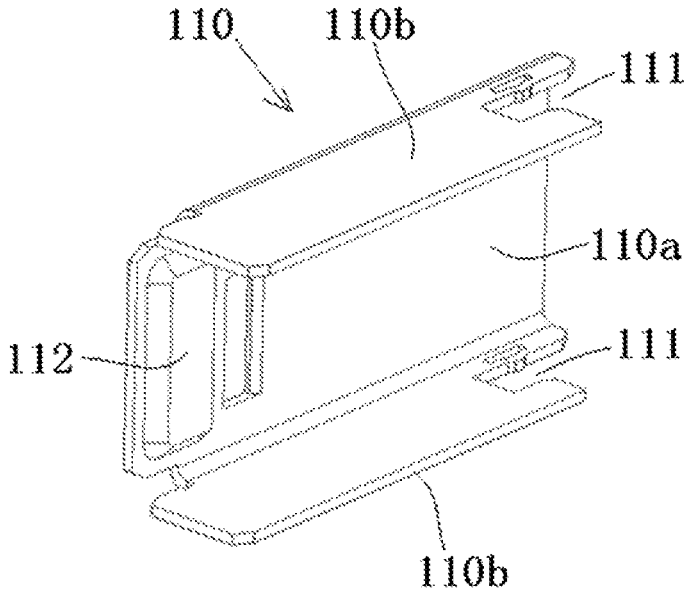
FIG. 9 is a perspective view of a member of the contact module of FIG. 7.

As shown in FIGS. 7-9, in an embodiment, the member 110 defines a chamber, and the contact portions 210, 310 of the signal contact 200 and the ground shield 300 are received in the chamber of the member 110.

In the embodiment shown in FIGS. 6-8, the connector comprises a plurality of signal contacts 200 configured in pairs, for example, a differential signal contact pair. The contact portions 210, 310 of each pair of signal contacts 200 and the corresponding ground shield 300 are received in the chamber of the corresponding member 110.

In an embodiment, each member 110 is detachably assembled to the insulation body 20. Each member 110, as shown in FIGS. 8 and 9, has a bottom wall 110*a* facing the signal contact 200 and a pair of side walls 110*b* at both sides of the bottom wall 110*a*. A notch 111 is formed in each side wall 110*b*. A protrusion 21 is formed on the insulation body 20 and is adapted to be latched into the notch 111. A protruding part 112 of the member 110, shown in FIGS. 8 and 9, protrudes toward the ground shield 300, so that the member 110 is closer to the ground shield 300 in space.

Figure 10:
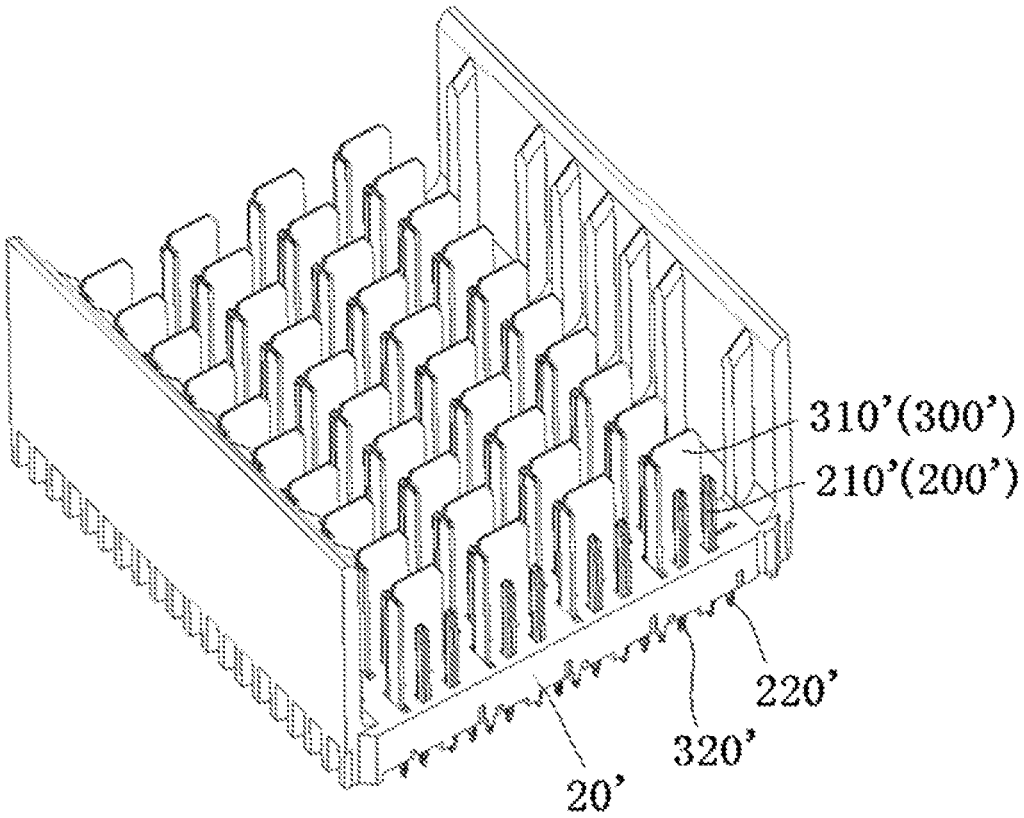
FIG. 10 is a perspective view of the mating connector of FIG. 6.
Figure 11:
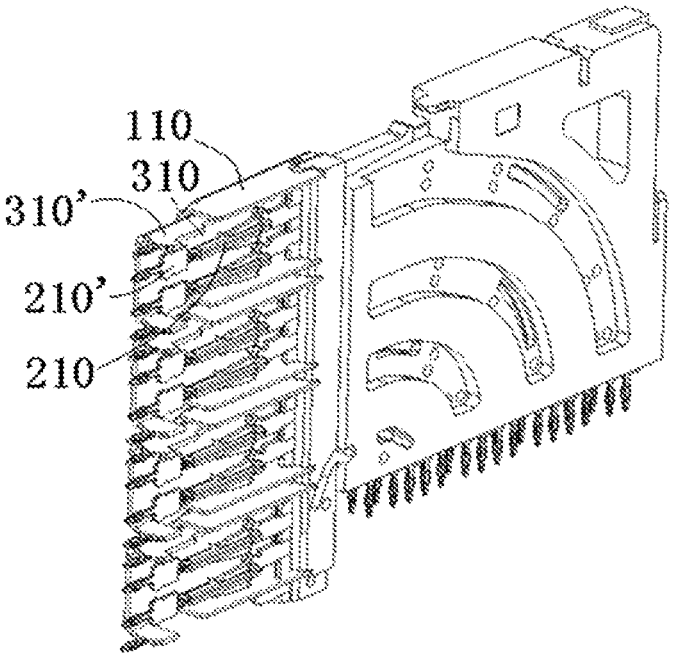
FIG. 11 is a perspective view of the contact module of FIG. 7 mated with the mating connector of FIG. 10.

The mating connector shown in FIG. 10 is adapted to be mated with the connector of FIG. 6. As shown in FIGS. 6, 10, and 11, when the connector is mated with the mating connector, a mating signal contact portion 210' of a mating signal contact 200' of the mating connector is inserted into the chamber of the member 110 and brought into electrical contact with the signal contact portion 210 of the signal contact 200 of the connector. A mating ground contact portion 310' of a mating ground shield 300' of the mating connector is inserted into the chamber of the member 110 and brought into electrical contact with the ground contact portion 310 of the ground shield 300.

As shown in FIGS. 6 and 7, in an embodiment, the signal contact 200 of the connector comprises a signal pin 220 at an end opposite the signal contact portion 210 and exposed outside of the insulation body 20. The signal pin 220 of the signal contact 200 is adapted to be inserted into a hole formed in a first circuit board. The ground shield 300 of the connector comprises a ground pin 320 at an end opposite the ground contact portion 310 and exposed outside of the insulation body 20. The ground pin 320 of the ground shield 300 is adapted to be inserted into a hole formed in the first circuit board. As shown in FIGS. 6, 10 and 11, in an embodiment, pins 220', 320' of the mating signal contact 200' and the mating ground shield 300' are exposed from a mating insulation body 20' of the mating connector and are adapted to be inserted into holes formed in a second circuit board.

As shown in the embodiment of FIG. 6, the connector comprises a plate holder 2 in which a plurality of insertion holes are formed. The pins 220, 320 of the signal contact 200 and the ground shield 300 are held in the insertion holes of the plate holder 2.

What is claimed is:

1. A connector, comprising:

a ground contact;

a signal contact;

a member made of a magnetic conductivity material or a low electrical conductivity metal, the member disposed near the ground contact; and an insulation body discrete from the member and defining an interior space in which the ground contact, the signal contact and the member are disposed.

2. The connector of claim 1, wherein the member is made of a high magnetic conductivity material.

3. The connector of claim 2, wherein the high magnetic conductivity material has a relative magnetic conductivity larger than ten.

4. The connector of claim 1, wherein the member is made of the low electrical conductivity metal and has an electric conductivity less than 1.16e6 siemens/meter.

5. The connector of claim 1, wherein the member comprises a coating layer disposed on the ground contact.

6. The connector of claim 1, wherein the ground contact is a ground terminal or a ground shield.

7. The connector of claim 1, wherein the member is in direct contact with the ground contact or is not in contact with the ground contact.

8. The connector of claim 1, wherein a distance between the member and the ground contact is in a range of 0-1 millimeter.

9. The connector of claim 1, wherein a distance between the member and the ground contact is in a range of 0-0.1 millimeter.

10. The connector of claim 1, wherein a distance between the member and the ground contact is in a range of 0-0.01 millimeter.

11. The connector of claim 1, wherein the member is disposed either at a top side of the ground contact or at a bottom side of the ground contact.

12. The connector of claim 1, wherein the member is a strip-shaped sheet member and is positioned either above or below the ground contact, the ground contact at least partially overlaps with the member in a width direction of the ground contact.

13. The connector of claim 1, wherein the member is a case member with a predetermined length and the ground contact is received in the member, the ground contact at least partially overlaps with the member.

14. The connector of claim 1, wherein the member has a width larger than or equal to a width of the ground contact and is above or below the ground contact, the ground contact is completely covered by the member in a width direction of the ground contact.

15. The connector of claim 1, wherein the member has a length larger than or equal to a length of the ground contact, the member extends over a whole length of the ground contact and completely overlaps with the ground contact in a direction of the ground contact.

16. The connector of claim 1, wherein the member has a length less than a length of the ground contact and at least partially overlaps with the ground contact in a length direction of the ground contact.

17. The connector of claim 1, wherein the ground contact and the signal contact include a plurality of ground contacts and a plurality of signal contacts, the plurality of ground contacts and the plurality of signal contacts being arranged in at least one row.

18. The connector of claim 17, wherein at least one signal contact is disposed between a pair of adjacent ground contacts.

19. The connector of claim 5, the member comprises an electroplated coating layer.

20. The connector of claim 1, wherein the member contains pure iron, silicon steel, alloy steel, stainless steel, or Ni—Fe—Cr alloy.

21. A connector, comprising:

a case;

a ground contact; and a plurality of contact modules arranged side by side in the case, each contact module including:

an insulation body;

a signal contact disposed within an interior space defined by the insulation body; and a member discrete from the insulation body and made of a magnetic conductivity material or a low electrical conductivity metal, the member disposed near the ground contact.

22. The connector of claim 21, wherein the ground contact is a ground terminal or a ground shield.

23. The connector of claim 21, wherein the member is made of a high magnetic conductivity material.

24. The connector of claim 23, wherein the high magnetic conductivity material has a relative magnetic conductivity larger than ten.

25. The connector of claim 21, wherein the member is made of the low electrical conductivity metal and has an electric conductivity less than 1.16e6 siemens/meter.

26. The connector of claim 21, wherein the ground contact is a ground shield disposed at a side of the insulation body, the ground shield has a ground contact portion at an end of the ground shield and exposed outside of the insulation body, the signal contact has a signal contact portion at an end of the signal contact and exposed outside of the insulation body, the ground contact portion is disposed near the signal contact portion and the member is disposed near the ground contact portion.

27. The connector of claim 26, wherein the ground shield includes a plurality of ground contact portions disposed near the signal contact portion, the member is disposed near the ground contact portions.

28. The connector of claim 26, wherein the member defines a chamber in which the ground contact portion and the signal contact portion are received.

29. The connector of claim 28, wherein the connector includes a plurality of signal contacts configured in pairs, the signal contact portions of each pair of signal contacts and the ground contact portion corresponding to the pair of signal contacts are received in the chamber of the member.

30. The connector of claim 29, wherein the member is detachably assembled to the insulation body.

31. The connector of claim 30, wherein the member has a bottom wall facing the signal contact and a pair of side walls extending from opposite sides of the bottom wall, a notch is disposed in each side wall and a protrusion of the insulation body is adapted to latch into the notch.

32. The connector of claim 28, wherein, when the connector is mated with a mating connector, a mating signal contact portion of a mating signal contact of the mating connector is inserted into the chamber of the member and electrically contacts the signal contact portion of the signal contact of the connector.

33. The connector of claim 32, wherein, when the connector is mated with the mating connector, a mating ground contact portion of a mating ground shield of the mating connector is inserted into the chamber of the member and electrically contacts the ground contact portion of the ground shield of the connector.

34. The connector of claim 33, wherein the member has a protruding part protruding toward the ground shield.

35. The connector of claim 26, wherein the signal contact has a signal pin disposed at an end opposite the signal contact portion and exposed outside of the insulation body, the signal pin is adapted to be inserted into a hole in a first circuit board, the ground shield has a ground pin disposed at an end opposite the ground contact portion and exposed outside of the insulation body, the ground pin is adapted to be inserted into a hole formed in the first circuit board.

36. The connector of claim 35, further comprising a plate holder having a plurality of insertion holes, the signal pin and the ground pin are held in the insertion holes.

37. The connector of claim 35, wherein a mating signal pin of a mating signal contact and a mating ground pin of a mating ground shield of a mating connector adapted to be mated with the connector are exposed outside a mating insulation body of the mating connector and are adapted to be inserted into a plurality of holes in a second circuit board.

38. A connector, comprising:

an insulation body;

a signal contact including a first portion arranged within the insulation body and a signal contact portion defining an end of the signal contact and exposed outside of the insulation body;

a ground contact including a first portion arranged within the insulation body and a ground contact portion defining an end of the ground contact and exposed outside of the insulation body; and a member made of a magnetic conductivity material or a low electrical conductivity metal, the member selectively attachable to an exterior surface of the insulation body and defining a chamber in which the ground contact portion and the signal contact portion are received when the member is attached to the exterior surface of the insulation body.

39. The connector of claim 38, wherein the ground contact is made of a high magnetic conductivity material.

40. The connector of claim 39, wherein the high magnetic conductivity material has a relative magnetic conductivity larger than ten.

41. The connector of claim 38, wherein the ground contact is made of the low electrical conductivity metal and has an electric conductivity less than 1.16e6 siemens/meter.

* * * * *